US009729953B2

(12) United States Patent
Armstrong

(10) Patent No.: US 9,729,953 B2
(45) Date of Patent: Aug. 8, 2017

(54) WEARABLE EARBUDS HAVING A REDUCED TIP DIMENSION

(71) Applicant: Logitech Europe S.A., Lausanne (CH)

(72) Inventor: Judd Armstrong, Parrearra (AU)

(73) Assignee: Logitech Europe S.A., Lausanne (CH)

( * ) Notice: Subject to any disclaimer, the term of this patent is extended or adjusted under 35 U.S.C. 154(b) by 0 days.

(21) Appl. No.: 14/809,115

(22) Filed: Jul. 24, 2015

(65) Prior Publication Data

US 2017/0026733 A1 Jan. 26, 2017

(51) Int. Cl.

*H04R 25/00* (2006.01)
*H04R 1/10* (2006.01)
*H04R 31/00* (2006.01)

(52) U.S. Cl.

CPC ..... *H04R 1/1016* (2013.01); *H04R 31/006* (2013.01)

(58) Field of Classification Search

USPC ..... 381/328
See application file for complete search history.

(56) References Cited

U.S. PATENT DOCUMENTS

| | | | |
|---|---|---|---|
| 2,189,096 | A | 2/1940 | Alonge |
| 3,543,724 | A | 12/1970 | Kirkpatrick et al. |
| 3,978,849 | A | 9/1976 | Geneen |
| 4,129,124 | A | 12/1978 | Thalmann |
| 4,224,948 | A | 9/1980 | Cramer et al. |
| 4,307,727 | A | 12/1981 | Haynes |
| 4,331,154 | A | 5/1982 | Broadwater et al. |
| 4,407,295 | A | 10/1983 | Steuer et al. |
| 4,409,983 | A | 10/1983 | Albert |
| 4,491,970 | A | 1/1985 | Lawhite et al. |
| 5,301,154 | A | 4/1994 | Suga |
| 5,392,261 | A | 2/1995 | Hsu |
| 5,406,952 | A | 4/1995 | Barnes et al. |
| 5,524,637 | A | 6/1996 | Erickson |
| 5,734,625 | A | 3/1998 | Kondo |

(Continued)

FOREIGN PATENT DOCUMENTS

| | | | |
|---|---|---|---|
| EP | 2299730 | A1 | 3/2011 |
| WO | 03015463 | A2 | 2/2003 |

(Continued)

OTHER PUBLICATIONS

"Elite Clock Military Style LED Watch" by ledwatchsuk. YouTube [dated May 31, 2011][online][retrieved on Aug. 14, 2015].

(Continued)

*Primary Examiner* — Amir Etesam
(74) *Attorney, Agent, or Firm* — Patterson + Sheridan, LLP

(57) ABSTRACT

An earbud audio device includes a housing, a speaker component and a cushion, wherein the speaker component forms the tip of the earbud upon which the cushion may be situated. The speaker component is mechanically coupled to the earbud housing in a manner that allows the cushion to be coupled thereto, the speaker component and tip able to be partially inserted into a user's ear canal during use. The speaker component may be formed with a flange extending outward to provide a support for mechanically coupling the speaker component to the housing. The speaker component and housing may in some instances be mechanically coupled together as two threaded components.

17 Claims, 6 Drawing Sheets

(56) References Cited

U.S. PATENT DOCUMENTS

| | | | | |
|---|---|---|---|---|
| 5,755,623 | A | 5/1998 | Mizenko | |
| 5,899,370 | A | 5/1999 | Bould | |
| 6,151,968 | A | 11/2000 | Chou | |
| 6,361,503 | B1 | 3/2002 | Starobin et al. | |
| 6,736,759 | B1 | 5/2004 | Stubbs et al. | |
| 7,192,401 | B2 | 3/2007 | Saalasti et al. | |
| 7,717,827 | B2 | 5/2010 | Kurunmaki et al. | |
| 7,914,425 | B2 | 3/2011 | Hanoun | |
| 8,992,385 | B2 | 3/2015 | Lemos | |
| 9,094,760 | B2 * | 7/2015 | Kaneko | H04R 1/1066 |
| 2002/0151811 | A1 | 10/2002 | Starobin et al. | |
| 2002/0188210 | A1 | 12/2002 | Aizawa | |
| 2003/0065269 | A1 | 4/2003 | Vetter et al. | |
| 2005/0056655 | A1 | 3/2005 | Gary | |
| 2005/0116811 | A1 | 6/2005 | Eros et al. | |
| 2005/0256416 | A1 | 11/2005 | Chen | |
| 2006/0183980 | A1 | 8/2006 | Yang | |
| 2007/0118043 | A1 | 5/2007 | Oliver et al. | |
| 2008/0086318 | A1 | 4/2008 | Gilley et al. | |
| 2008/0132383 | A1 | 6/2008 | Einav et al. | |
| 2008/0228089 | A1 | 9/2008 | Cho et al. | |
| 2008/0267438 | A1 | 10/2008 | Chen et al. | |
| 2009/0312656 | A1 | 12/2009 | Lau et al. | |
| 2010/0197463 | A1 | 8/2010 | Haughay, Jr. et al. | |
| 2010/0220884 | A1 * | 9/2010 | Aquilina | H04R 25/608 381/328 |
| 2011/0021319 | A1 | 1/2011 | Nissila et al. | |
| 2011/0092790 | A1 | 4/2011 | Wilder-Smith et al. | |
| 2011/0158457 | A1 | 6/2011 | Ishizaka | |
| 2011/0260870 | A1 | 10/2011 | Bailey | |
| 2012/0022341 | A1 | 1/2012 | Zdeblick | |
| 2012/0168471 | A1 | 7/2012 | Wilson | |
| 2012/0253485 | A1 | 10/2012 | Weast et al. | |
| 2013/0064049 | A1 | 3/2013 | Pileri et al. | |
| 2013/0237778 | A1 | 9/2013 | Rouquette | |
| 2014/0032234 | A1 | 1/2014 | Anderson | |
| 2014/0073486 | A1 | 3/2014 | Ahmed et al. | |
| 2014/0107493 | A1 | 4/2014 | Yuen et al. | |
| 2014/0228175 | A1 | 8/2014 | Lemos et al. | |

FOREIGN PATENT DOCUMENTS

| | | | |
|---|---|---|---|
| WO | 2012006383 | A1 | 1/2012 |
| WO | 2014013353 | A1 | 1/2014 |

OTHER PUBLICATIONS

"watch Stylish Blue Light LED Round Dial Matrix Stainless from ChinaBuye.com" by YnopoB. YouTube [dated Apr. 23, 2012][online][retrieved on Dec. 31, 2015] (https://www.youtube.com/watch?v=e_LWbXHvvWg).

International Search Report dated Apr. 11, 2016 for Application No. PCT/IB2016/001049.

* cited by examiner

WEARABLE EARBUDS HAVING A REDUCED TIP DIMENSION

TECHNICAL FIELD

The present disclosure relates generally to the field audio output devices, and more particularly to earbud audio devices having one or more reduced tip dimensions optimized for users having smaller than average ear canal anatomy.

BACKGROUND

Personal audio devices have been used with increasing regularity in recent years, and a greater number of people are using headphones as part of their daily activities. Consequently, engineering headphone devices has become a robust and specialized field requiring advanced technologies to meet the design, aesthetic, and functional requirements of the various users of these devices. Headphones come in a variety of shapes and sizes. One type of headphone device includes two small speakers held within two separate enclosures that are meant to fit or rest directly within a user's ear. These headphone devices are commonly called earphones or earbuds. Because the anatomy of each person's ear is unique, however, earbuds that are mass produced do not always provide an adequate fit for each unique user's individual ear anatomy. For users with small ears, an earbud that fits too tightly within the ear canal can cause discomfort during use. In some instances, the inadequacy of the fit renders the earbuds entirely unusable.

Though some have attempted to remedy this problem by providing cushions in multiple sizes (e.g. typically two to three different sizes—small, medium, large—may be provided), the fit remains inadequate for those having inner ear canal dimensions much smaller than average. This entails nearly 10% of users.

Finding an adequate remedy to this problem is complicated by the structural limitations and performance requirements of certain earbud devices.

Structurally, an earbud generally has a plastic or metal housing that encloses several electronics, including at the very least a speaker component and appropriate wiring. Advanced earbud devices can include BLUETOOTH wireless connectivity, and thus require the earbud housing to enclose additional electronic components (e.g. a battery, a circuit board, an amplifier, a channel equalizer, a wired or wireless receiver, or other audio-electronic circuitry). Earbud devices typically have a tip extending outward from the remainder of the housing, upon which a silicone or foam cushion may be attached. Thus, the size of the cushions used with a particular set of earbuds is necessarily limited by the size of the tip. Accordingly, for user's with small ears, decreasing the overall diameter or thickness dimension of the earbud tip is essential to enabling the use of sufficiently small earbud cushions.

With respect to performance, the capacity of the electronics within an earbud are limited by their size. For instance, a speaker functions by pushing and pulling air molecules to generate pockets of high and low pressure that the human eardrum is capable of detecting, and that the human brain is capable of interpreting as sound. As the size of speaker parts (e.g. voice coil, spider, cone, magnet) decrease, so does the speaker's capacity to push and pull air molecules to generate sound. In other words, smaller speakers generate less volume and produce narrower frequency ranges than larger speakers. To some degree, the lower capacity of small speakers can be alleviated by bringing the speaker in close proximity to the user's eardrum. The closer the speaker is to a user's eardrum, the easier it is for the human eardrum to detect the pressure fluctuations. Moreover, the closer the speaker is to the user's eardrum, the less noise exists that can interfere with the already small pressure fluctuations. Thus, an optimal earbud design includes a speaker component that is situated at or near the tip of the earbud—the part actually inserted into the user's ear canal.

Accordingly, a problem exists. In particular, making an earbud tip small enough to accommodate very small ear canal's would require—in presently earbud models—moving the speaker component out of the earbud tip and into the remainder of the earbud housing so that the tip size can be reduced. But moving the speaker component into the remainder of the housing moves speaker parts further from the user's eardrum, thereby reducing the overall sound quality as described above. What's more, moving the speaker into the housing means less space for the other components disposed within the housing. This can be particularly problematic for wireless earbuds—which also house batteries, receivers, channel equalizers, and other components—where space within the housing is already limited. For instance, further congesting the earbud housing space with the speaker component might mean having to reduce the size of the battery, which would reduce the time a person can use the earbuds on a single charge.

This dilemma makes it challenging to design earphones that provide an adequate fit for users having small ear canal dimensions, but still maintain the sound quality and other advantages (described above) that come from situating the speaker component at the tip of the earbud device.

BRIEF SUMMARY OF EMBODIMENTS

Embodiments of this disclosure provide an improved earbud device optimized to permit a more customized and precise fit for certain users—especially for users whose ear anatomy is much smaller than average.

Embodiments of the present disclosure include an earbud device with a tip defined by the speaker component itself rather than by a tube extending from the earbud housing to further enclose the speaker component. Accordingly, the overall diameter or thickness dimension of the tip is reduced by eliminating the tube extending from the earbud housing which typically defines the outermost boundary of the tip. This is made possible by securing one end of the speaker component to the remainder of the earbud housing so that the speaker component itself can serve as the tip upon which a cushion may be secured and inserted into the user's ear canal. This helps maintain optimum sound quality and isolation by maintaining the speaker at the tip of the device—in close proximity to the user's eardrum—and at the same time providing a better fit for users with smaller ears by reducing the overall tip diameter or thickness dimension.

Furthermore, some embodiments disclosed herein include mechanically coupling the speaker component to the remainder of the housing by forming the speaker component with a flange or lip extending outward from an end of the speaker component. The flange can create a perpendicular or near perpendicular angle with the longitudinal axis of the speaker component, or be configured to form a substantially acute or substantially obtuse angle with the longitudinal axis of the speaker component. Embodiments of the disclosed technology enable secure joining of the speaker component with the housing of the earbud to prevent detachment under normal use conditions.

Some embodiments provide a speaker component flange made of a rigid material (e.g. hard plastic or metal) so that the speaker component retains a substantially fixed position with respect to the earbud housing. Other embodiments include a flange made, in whole or in part, with a flexible material such as rubber, silicone, or soft plastic such that the speaker component may be bent toward the wearer's ear canal for a more customized fit. Indeed, some flange materials may comprise a shape memory material such that the speaker component may be bent at a particular angle relative to the housing, and substantially retain a particular shape/angle preferred by the user.

One embodiment provides earbuds that can be easily customized to fit each individual's unique ear shape. Another embodiment provides earphones that permit the wearer to adjust to their particular comfort levels, permitting the earphone to be worn for long periods of time with eliminated or reduced discomfort. The customized fit made possible by the reduced diameter or thickness dimension of the earbud tip reduces discomfort (especially during periods of extended use), and enhances the overall sound quality experienced by the user.

Some embodiments disclosed herein eliminate the tube used in current earbud models, and utilize the structure of the speaker component itself as the tip of the earbud—configuring the speaker component such that the cushion may be situated thereon. Eliminating the tube portion further reduces the overall diameter or thickness dimension of the earbud tip, allowing for the design of smaller cushions to satisfy the dimensional requirements of those users with small ear canals. An estimated 10% of the population, particularly petite persons and youth, find difficulty or discomfort trying to fit the cushion and tip of current earbud models into their ear canals. Embodiments of the present disclosure enhance the comfort level and user experience of these and other users by allowing for smaller cushions to be situated on the tip of an earbud device while substantially retaining the proximity of the speaker component within the user's ear canal for optimal sound quality.

Other features and aspects of the disclosed technology will become apparent from the following detailed description, taken in conjunction with the accompanying drawings, which illustrate, by way of example, the features in accordance with embodiments of the disclosed technology. The summary is not intended to limit the scope of any embodiments described herein, which are defined solely by the claims attached hereto.

BRIEF DESCRIPTION OF THE DRAWINGS

The technology disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

Figure 1:
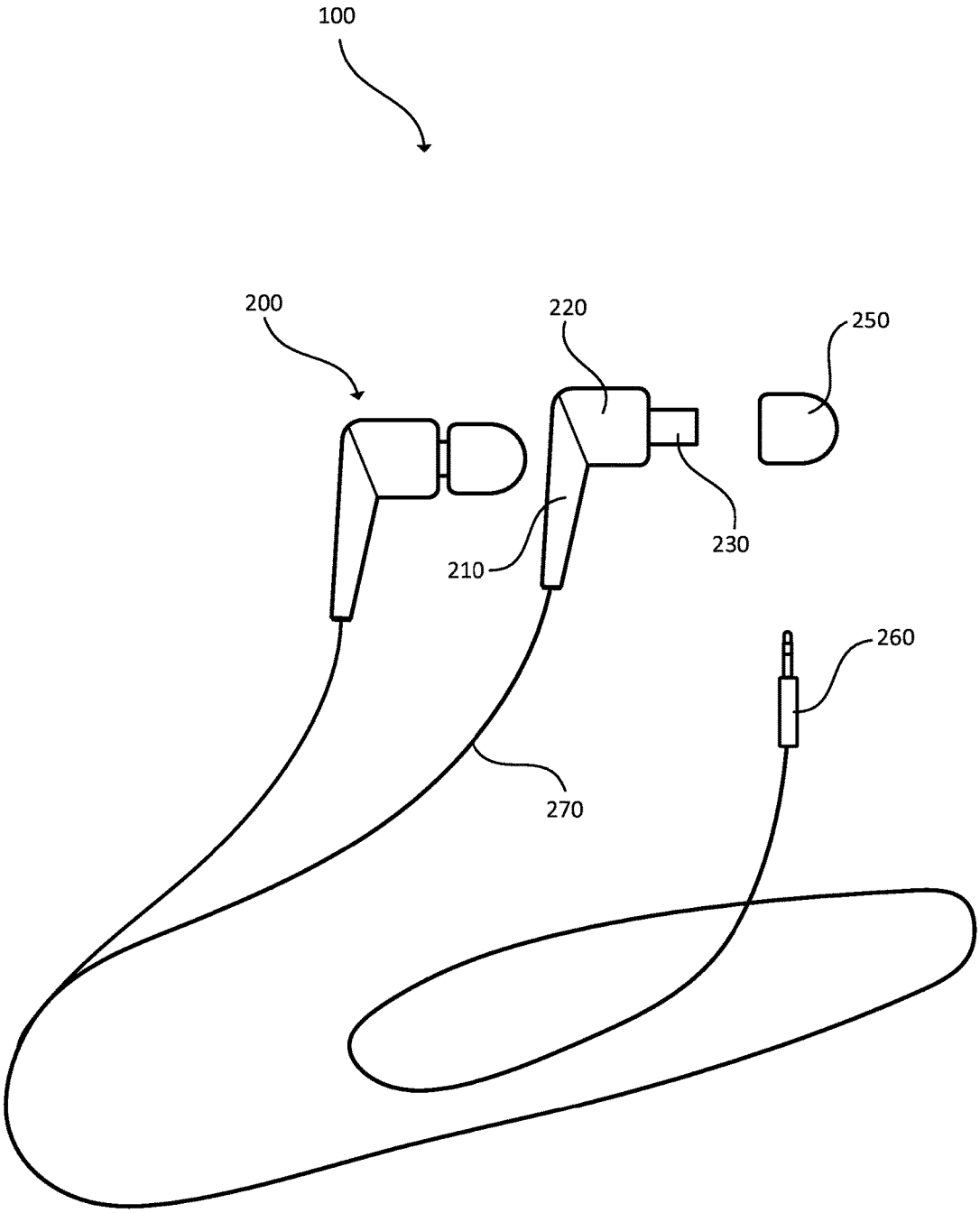
FIG. 1 is a perspective view diagram illustrating an exemplary standard set of earbuds in accordance with typical prior art devices.

The figures are not intended to be exhaustive or to limit the disclosure to the precise form disclosed. The figures are not drawn to scale. It should be understood that the disclosed technology can be practiced with modification and alteration, and that the disclosed technology be limited only by the claims and the equivalents thereof.

DETAILED DESCRIPTION OF THE EMBODIMENTS

The technology disclosed herein is directed towards audio earbuds with a more customized fit for users having unique or smaller than average ear anatomy. Specifically, an earbud device in accordance with embodiments disclosed herein may include a housing, a speaker component forming a tip, a cushion, and a cord. The housing contains electronic components including at least the wire leading to the speaker component. The proximal end of the speaker component mechanically couples to a distal end of the housing such that the speaker component itself forms the tip of the earbud device. The mechanical coupling mechanism joining the speaker component to the housing secures the speaker component with sufficient strength that a cushion may be attached thereto and the speaker component and cushion can be further inserted into a portion of a user's ear canal. Thus, the speaker component forms the tip of the earbud, the longitudinal axis of the tip forming a first angle with respect to a longitudinal axis of the housing.

In some embodiments, the proximal end of the housing is shaped to form an aperture that matches an outside radial profile of the cord and a distal end of the cord is disposed within and secured by the proximal end of the housing. In other embodiments, the housing is further coupled to a strain relief, the distal end of the strain relief being mechanically coupled to a side of the housing. In some such embodiments, the proximal end of a strain relief may be shaped to form an aperture that matches an outside radial profile of the cord and a distal end of the cord is disposed within and secured by the strain relief.

With a tip formed from the speaker component alone, the tip is optimized to achieve an overall reduction in diameter or perimeter dimension when compared to presently available earbuds. Again, presently available earbud devices typically include a tip formed from a portion of or an extension of the housing—the tip portion of the housing surrounding the speaker component and adding to the overall diameter or perimeter dimension. The overall reduction in tip diameter or perimeter dimension enabled by the present disclosure achieves an optimal structure that functions not only to (i) accommodate cushions designed for those with smaller ear anatomies, but also in other cases to (ii) provide additional space that may be used to provide a molded or more customized cushion attachment for users with otherwise unique ear anatomies, and in still further cases to (iii) provide additional space between the outside edge of the tip and the outside edge of the cushion where additional noise cancelling and/or sound optimizing materials may be disposed (e.g. foam with noise canceling properties). For at least these reasons, the embodiments of the present disclosure can be utilized to enhance the sound quality and overall entertainment experience of the user, whether the user has above average, below average, or average ear canal anatomy.

In some example embodiments, the housing is rigid shell that surrounds electronic components. For example, the electronic components may include a battery or audio-electronic components such as a circuit board, an amplifier, a channel equalizer, a receiver (e.g., a wired or a wireless receiver), or other audio-electronic circuitry. The rigid shell may be made with plastic, metal, rubber, or other materials known in the art. The housing may be cubic shaped, prism shaped, tubular shaped, cylindrical shaped, or otherwise shaped to house the electronic components.

In some example embodiments, the speaker component forming the tip may be manufactured to be substantially cylindrical, parallelepiped, cubical, or other customized shape, with an outer edge that is substantially smooth, or with an outer edge that contains grooves, channels, or other structural distinctions for holding cushion attachments in place.

In some embodiments the distal end of the housing is shaped to form an aperture that matches an outside radial profile of the proximal end of the speaker component. The proximal end of the speaker component may be threaded, and the aperture boundary formed at the distal end of the housing boundary be likewise be reciprocally threaded to receive the proximal end of the speaker component. Accordingly, in some embodiments the speaker component may be mechanically coupled to the housing by being threaded thereto.

In still further embodiments, the tip may be formed with one or more flange(s) at or near the proximal end of the speaker component, the flange(s) extending outward from the speaker component such that the flange(s) makes an angle, $F_\theta$, with the longitudinal axis of the speaker component; a first angle, $F_{\theta 1}$ a for a single flange; a first angle and second angle, $F_{\theta 1}$ and $F_{\theta 2}$, for a first and second flange, etc. The flange(s) may be used to mechanically couple the speaker component to the housing by fixing one or more of the flange(s) to a portion of the housing through plastic welding, adhesives and/or epoxies, and/or custom fitting. In some example embodiments the flange is fixed to the inside wall of the housing, and in other examples the flange is fixed to the outside wall of the housing. In still further embodiments, the speaker component may be formed with two or more flanges separated by a longitudinal distance along the speaker component's longitudinal axis, the edge of the housing fitted in-between the two or more flanges.

In some example embodiments, the speaker component is mechanically coupled to the housing such that the longitudinal axis of the speaker component forms a fixed first angle with the longitudinal axis of the housing. In other embodiments, the speaker component is mechanically coupled to the housing such that the first angle between the longitudinal axes of the speaker component and the housing is not fixed, but instead is adjustable. For example, the flange may be made in part with a flexible material that—while being adhered securely to the housing—also allows the tip (i.e. the speaker component) to be bent relative to the earbud housing. In such embodiments, the flexible flange material can allow the tip to be more specifically angled to match the orientation of the user's ear canal.

In some example embodiments, the cushion may be shaped to comfortably and securely fit within a wearer's ear canal, with the distal end of the tip contacting an outer rim of the wearer's ear canal. The cushion may be rounded, parabolic, semi-spherical, multi-flanged, or have another custom profile, and be made of silicones, foams, soft rubbers, soft plastics, fabric, shape memory materials, or other materials as would be appreciated by one of ordinary skill in the art, including combinations of these shapes and materials.

In still further example embodiments, the cushion may be removable such that it may be exchanged with alternate cushions of varying dimensions, colors, or designs to accommodate a wearer's preference and/or fit more closely match the radial profile of the wearer's ear canal. The cushion may be made with softer materials such as rubber, silicone, fabric, or other materials as would be appreciated by one of ordinary skill in the art.

Electronic wires may be disposed within the cord. The electronic wires may carry power and other electronic signals to the electronic components of the earbud from a controller and/or other electronic components housed within or fixed to another earbud. Accordingly, some example embodiments may include a strain relief that is rigid or semi-flexible and configured to secure the cord in place and absorb any tension applied to the cord from an external source, as to reduce the tension that would have otherwise been translated to connection or solder joints between the electronic wires and the electronic components within the housing.

FIG. 1 illustrates a perspective view of an example set of typical earbuds as viewed from a side perspective. As illustrated, the external structure of each earbud 200 can be described generally as having a strain relief 210, a housing 220, a tip 230 and a cushion 250. Each earbud 200 contains electronic components configured to receive audio signals from an audio device through wires disposed within cord 270 and connected to an audio device via auxiliary connector 270. In some earbud devices, the strain relief 210, housing 220 and tip 230 are joined together by a plastic weld, adhesive, or other fastening mechanism. Though not depicted in FIG. 1, earbuds 200 may be configured to receive audio signals wirelessly, via BLUETOOTH for example, and thereby only be connected to one another via cord 270, eliminating the auxiliary connector 260 altogether.

Figure 2:
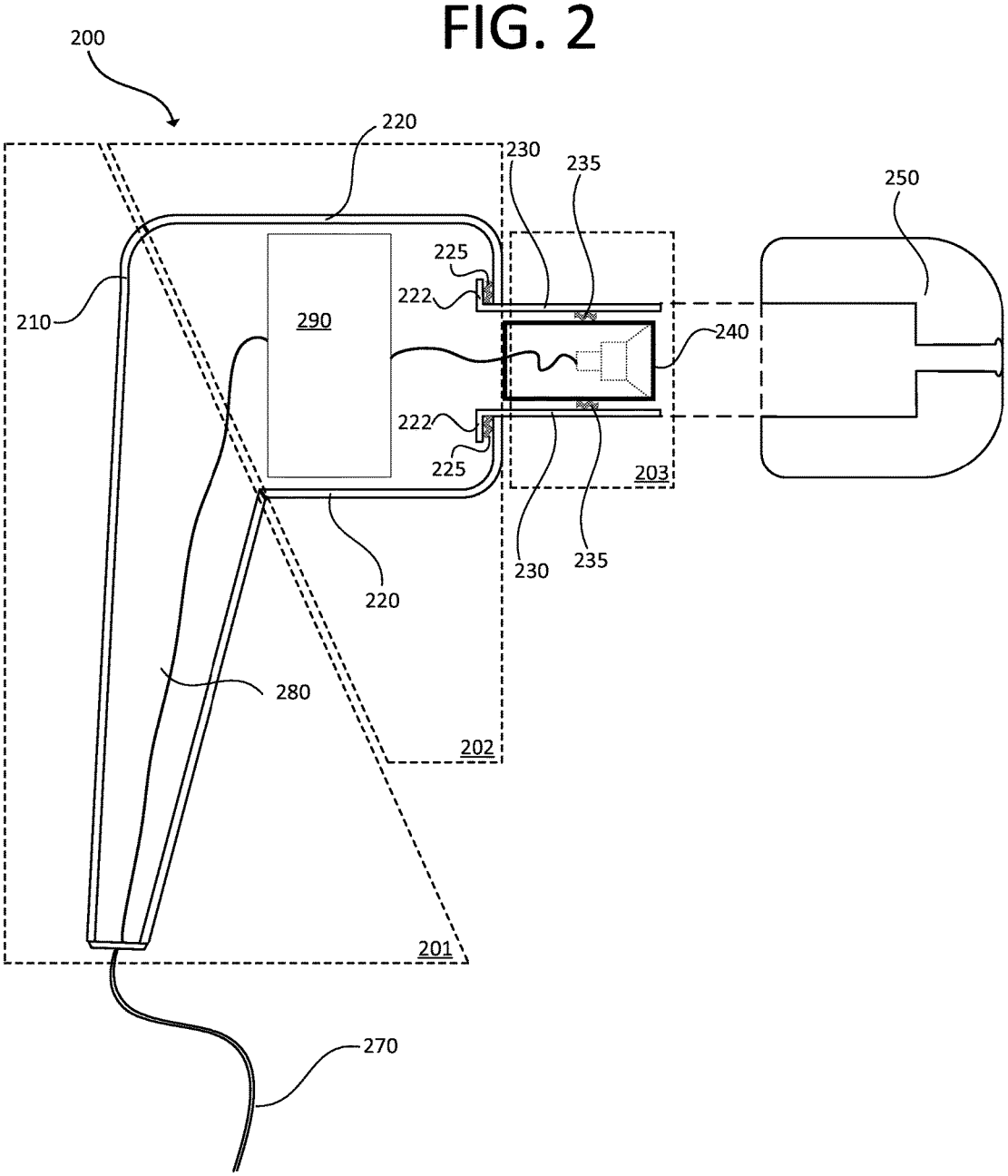
FIG. 2 is a cross-section side view of an exemplary standard earbud housing in accordance with typical prior art devices.

FIG. 2 illustrates a two dimensional cross-section side view of a typical earbud 200, the cushion 250 being depicted as having been removed from the tip 203 for clarity of discussion. As illustrated, the earbud enclosure can be generally described as having three portions, a strain relief portion 201, a primary housing portion 202, and a tip portion 203, which may be joined together by a plastic weld joint 215, or by an adhesive 225 applied between overlapping portions, or by other similar mechanisms. Additionally, many earbud devices are designed such one or more of these portions are formed as a single unit. Thus, in some devices the strain relief portion 203 and the primary housing portion 202 are formed as a single piece which is later joined with the tip portion 203; or the primary housing portion 202 and the tip portion are formed as a single piece that is later joined with the strain relief portion 201; or other combinations that may or may not include all of these portions. Indeed, some earbud devices do not include a strain relief portion 201 at all, the enclosure being defined solely by a primary housing portion 202 and tip portion 203. However, for clarity of description, this disclosure will refer to these three general portions separately, a person of ordinary skill in the art understanding that the various arrangements discussed above may be implemented without departing from the scope of the technology disclosed herein.

As depicted in FIG. 2, the strain relief portion typically includes the strain relief 210 enclosure itself with appropriate wires disposed within to enable signal communication between components and devices. The primary housing portion 201 typically includes the housing 220 enclosure itself, enclosing various electronic components 290 (only symbolically represented by box 290) and wires to support audio functionality. The tip portion 203 typically includes a tube 230 extending from the housing 220 and enclosing a speaker component 240. As depicted, an adhesive 235 or other attachment mechanism may be disposed between the exterior of the speaker component 240 and the inside wall of the tube 230 to secure the speaker component 240 within the tube 230. As further depicted in FIG. 2, an aperture within the cushion 250 is typically fitted to the outside wall of the tube 230 such that the cushion 250 may be easily attached to and detached from the tube 230 of the earbud.

Figure 3:
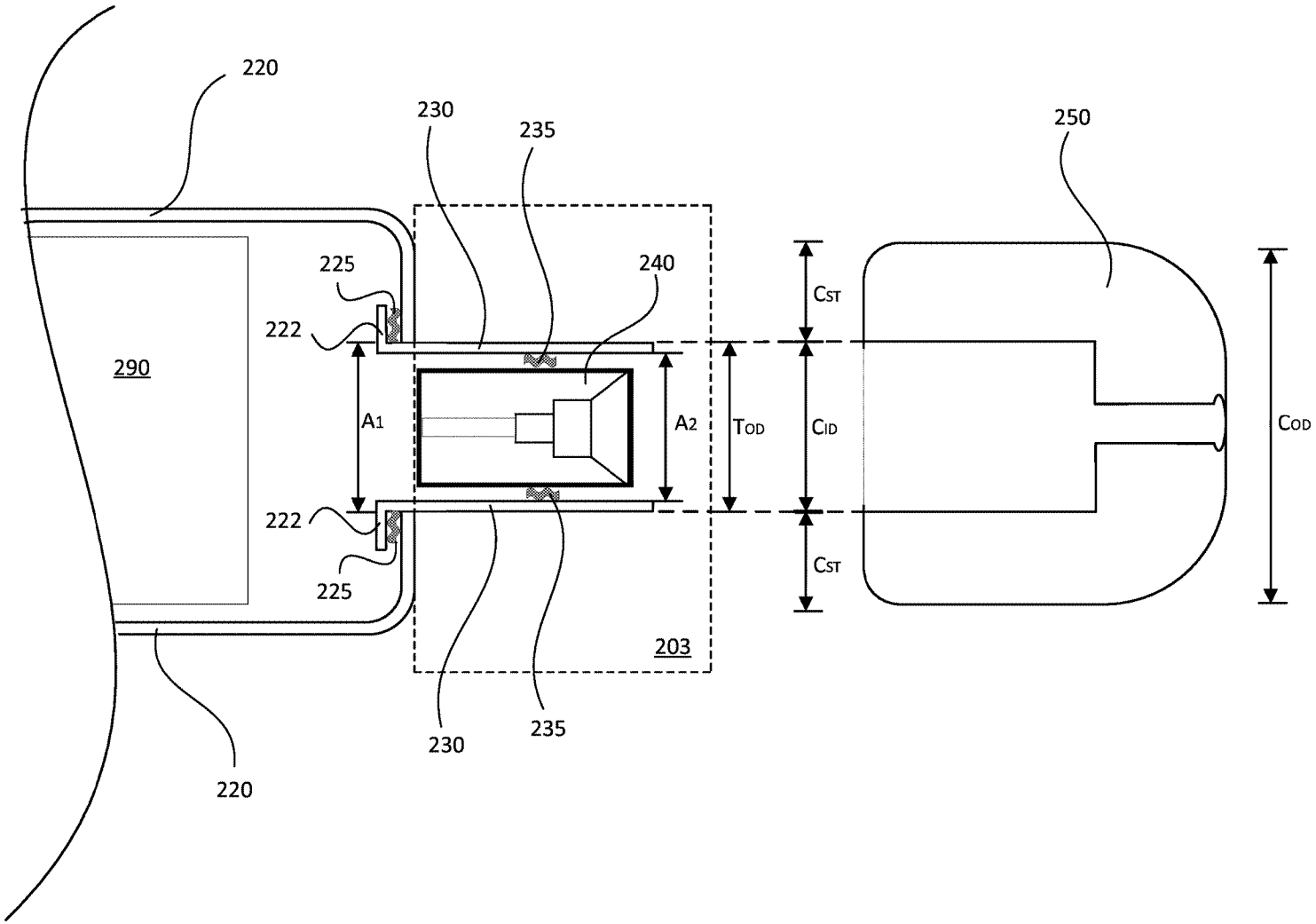
FIG. 3 is a magnified cross-section view of an exemplary standard earbud tip in accordance with typical prior art devices.

FIG. 3 illustrates a magnified cross-section side view of a typical earbud tip 203, with surrounding structures and dimension labels, and the cushion depicted in position removed from the tip 203. As illustrated, the tube 230 may be formed with a flange 222 extending radially outward from a proximal end of the tube 230, an adhesive 225 being applied between the flange 222 and inside wall of the housing 220 to secure the tube 230 to the housing 220 of the earbud 200. The housing 220 may be formed with an aperture of dimension (e.g. diameter, height, etc.) $A_1$, to allow a space wherein a portion of tube 230 may be situated, and providing access to the interior wall of the housing 220 to which flange 222 of the tube 230 may be attached. Additionally, the tube 230 of an earbud is formed with an aperture of dimension $A_2$, which is often covered in part by a filter or other protective material (not depicted).

As can be seen in FIG. 3, the cushion 250 is at least partially hollow, the aperture defining the hollow having a dimension defined as $C_{ID}$. As illustrated in FIG. 3, the internal dimension $C_{ID}$ of the cushion must accommodate the outside dimension, $T_{OD}$, defined by the exterior wall of the tube 230. In particular, presently available earbud devices require that the cushion 250 be formed such that its inside dimension (e.g. diameter, height, etc.), $C_{ID}$, is at least as large as the outside dimension (e.g. diameter, height, etc.), $T_{OD}$, of the tube 230 when the cushion 250 is secured in place around the tube 230 during use. And though the cushion 250 may be made of a formidable material with a relaxed $C_{ID}$, smaller than the outer dimension, $T_{OD}$, of the tube 230, the cushion 250 must ultimately stretch to conform to the outer perimeter of the tube 230 when placed on the tube during use. That is, the smallest $C_{ID}$, dimension fitting round the tube 230 in currently available earbuds can never be less than the smallest $T_{OD}$ dimension of the tube 230 upon which it is situated.

As illustrated further by FIG. 3, the outside dimension of the tube, $T_{OD}$, must be at least as large as the combined respective dimensions of the speaker component 240, the adhesive 235 (or other attachment mechanism that may be employed) and the thickness of the material used for the tube 230 enclosure itself. Moreover, the outer dimension, $C_{OD}$, of the cushion 250 can only be as small as permitted by the outer dimension, $T_{OD}$, of the tube 230; the $C_{ST}$ dimension defining the area spanned by the cushion material between the outside dimension, $T_{OD}$, of the tube 230 and the inside dimension of the user's ear canal during use.

Figure 4:
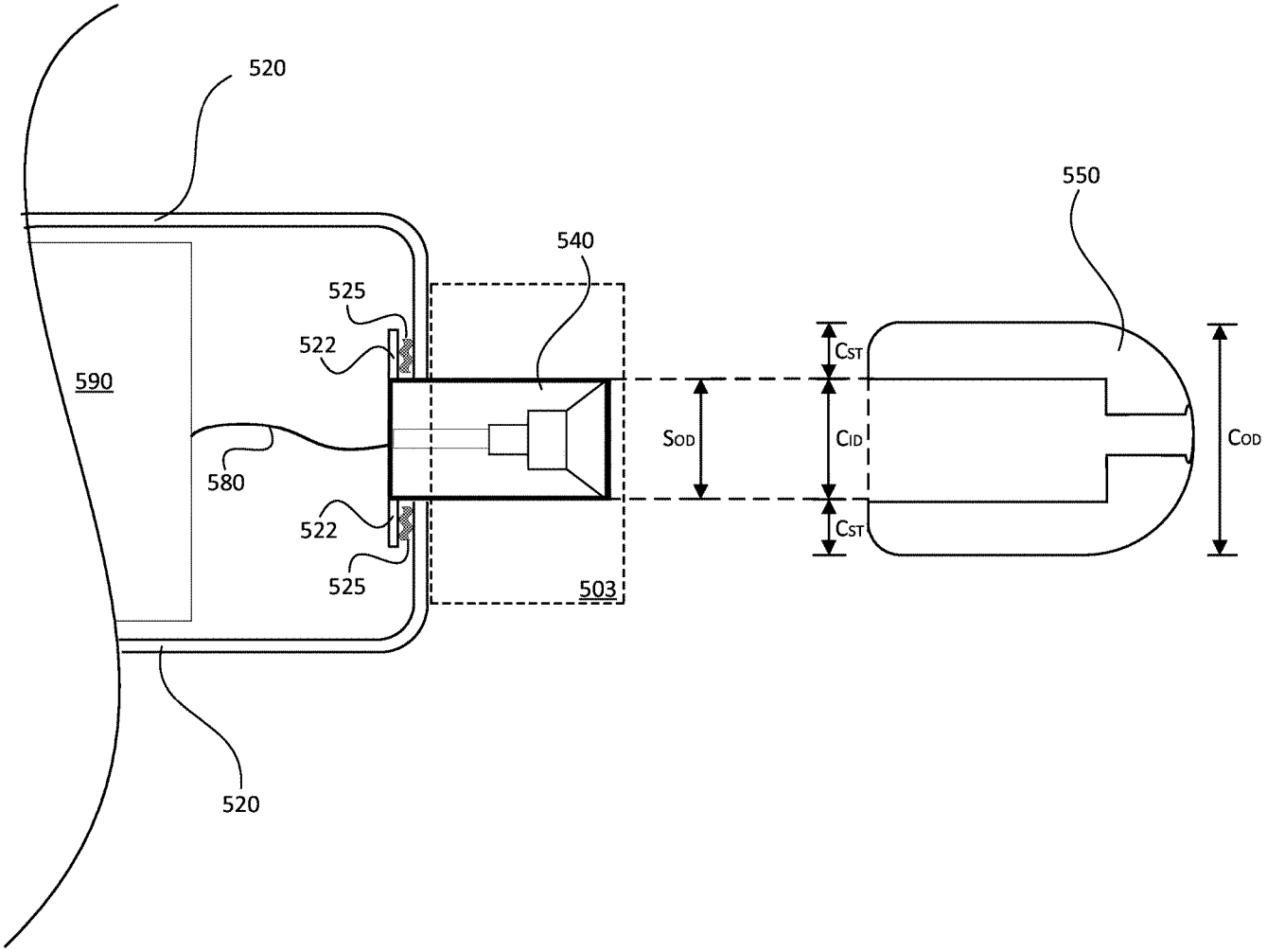
FIG. 4 is a magnified cross-section view of an exemplary earbud tip in accordance with embodiments of the technology disclosed herein.

FIG. 4. illustrates a magnified cross-section side view of an optimized earbud tip in accordance with one embodiment of the technology disclosed herein. As depicted, the speaker component 540 is formed with one or more lip(s) or flange(s) 522 extending outward from the proximal end of the speaker component, the flange(s) 522 of the speaker component 540 being joined to an inside wall near an aperture A1 at the distal end of the housing 520. Because FIG. 4 depicts only a cross-section view, a speaker component formed with two flanges—one extending from the top and one extending from the bottom—may also be depicted as having the same cross sectional view as a speaker component formed with a single flange extending outward along the entire perimeter of the proximal end of the speaker component. The cross section view of FIG. 4 is intended to encompass embodiments with either configuration. Indeed, embodiments of the presently disclosed technology may include a speaker component with one or more flanges extending from a proximal end of the speaker component to provide support for securing the speaker component to the housing. Although the speaker component 540 of the example embodiment is shown as including a cone speaker element, the illustrated embodiment should not be interpreted as limiting the scope of the technology disclosed herein. In other embodiments, the speaker component 540 may include a rectangular speaker element that fills the entire internal cavity of speaker component 540. The technology disclosed herein is not limited to any specific speaker element configuration.

As illustrated in the figure, the flange(s) 522 is joined to an inside wall of the housing by adhesive 526. In some embodiments the flange(s) 522 form a perpendicular or substantially perpendicular angle with the longitudinal axis, $S_{LA}$, of the speaker component 540, the longitudinal axis, $S_{LA}$, of the speaker component 540 being substantially parallel with the longitudinal axis, $H_{LA}$, of the housing 520. Notably, the embodiments of the present technology depicted in FIG. 4 illustrate how the optimized earbud tips eliminate the tube 230 used in the prior art devices depicted in FIGS. 2-3. Securing the speaker component 540 to the housing 520 such that it can function as the tip 503 upon which the cushion 550 may be secured allows for removal of the tube 230 (see FIGS. 2-3) of prior art earbuds altogether. With the speaker component 540 itself serving as the tip 503 of the earbud, cushion 550 dimensions may be minimized, enabling smaller cushion sizes to be used to accommodate smaller users. In particular, the inner dimension, $C_{ID}$, of the cushion 550 need only conform to the outer dimension, $S_{OD}$, of the speaker component 540 itself, thereby allowing the outer dimension, $C_{OD}$, of the cushion 550 to made smaller than would otherwise be possible in currently available earbuds (i.e. earbuds which dispose the speaker component within an additional tube portion extending from the housing as depicted in FIGS. 2-3).

In some embodiments, the decreased inner dimension, $C_{ID}$, of the cushion 550 made possible by the technology disclosed herein may provide for additional space (i.e. by increasing the $C_{ST}$ dimension) which can be filled by noise canceling or other comfort materials. Such embodiments are applicable to the standard cushions used by those having average or above average ear canal dimensions. Moreover, in other embodiments, the decreased inner dimension, $C_{ID}$, can provide the additional space that may be desirable for molded or other customized cushion designs.

Figure 5A:
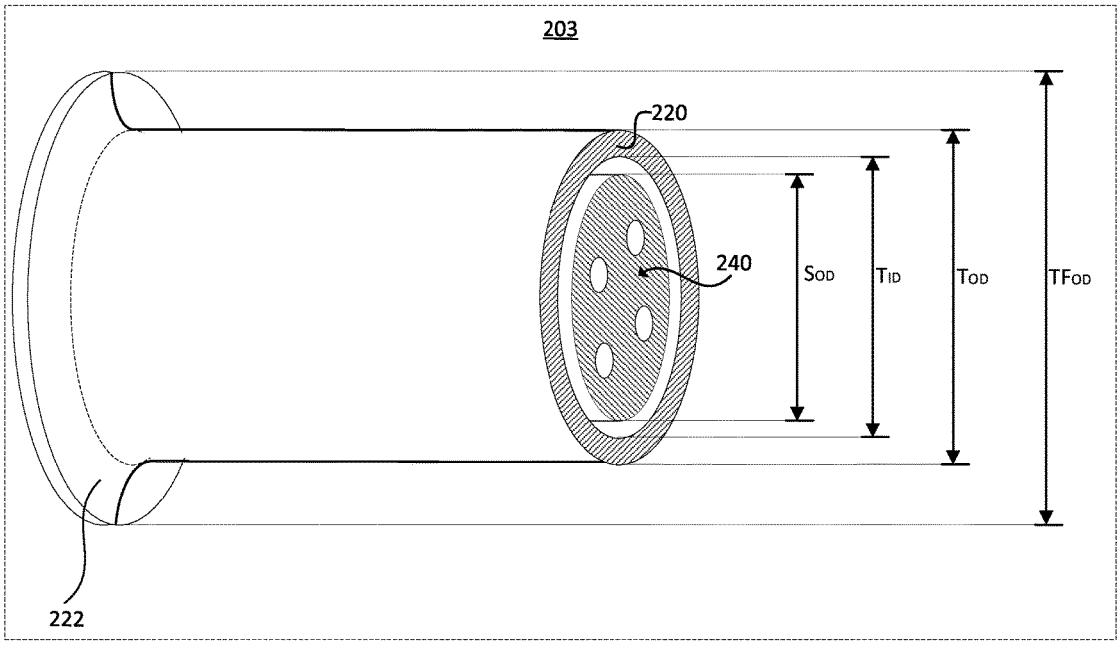
FIG. 5A is a magnified perspective view diagram illustrating an exemplary standard earbud tip in accordance with typical prior art earbud devices.
Figure 5B:
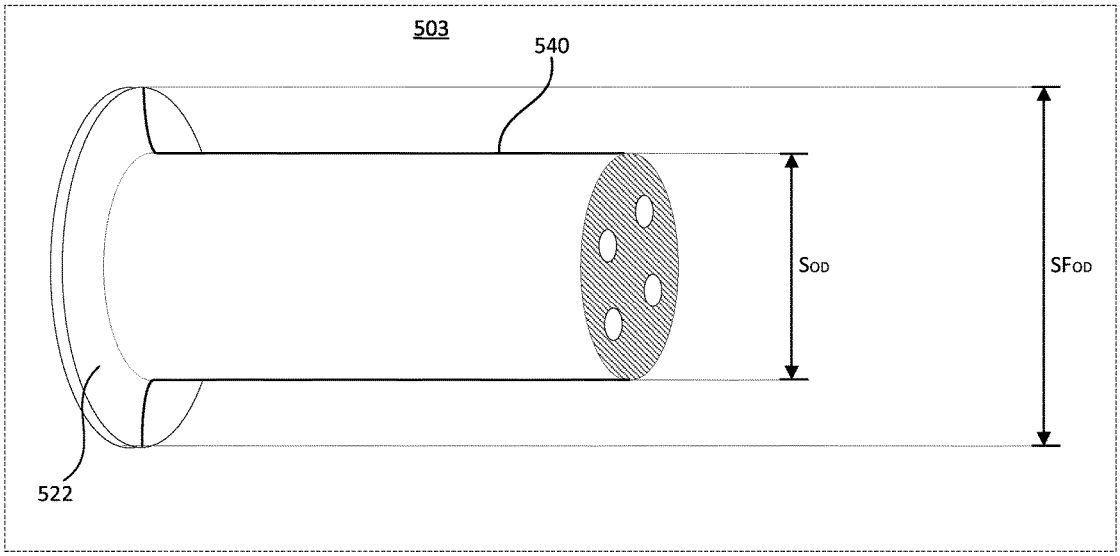
FIG. 5B is a magnified perspective view diagram illustrating an exemplary earbud tip in accordance with embodiments of the technology disclosed herein.

FIGS. 5A-5B depict magnified perspective views illustrating a comparison between a simplified example earbud tip used in currently available earbuds (FIG. 5A), and an example optimized earbud tip in accordance with embodiments of the technology disclosed herein (FIG. 5B). In FIG. 5A, speaker component 240 is disposed within tube 230, the space measured as the difference between the outer dimension, $S_{OD}$, of the speaker component 240 and the inside dimension, $T_{ID}$, of the tube 230 defining the area within which an adhesive or other attachment mechanism may be disposed to secure the speaker component 240 to the tube 230. As depicted in FIG. 5A, the outermost dimension of the tip is defined by the outer dimension, $T_{OD}$, of the tube 230. The outer dimension $T_{OD}$, of the tube 230 being at least as large as the combined respective dimensions of the speaker component 240, $S_{OD}$, any space required for use of an adhesive or other attachment mechanism, calculated as the difference between $T_{ID}$, and $S_{OD}$, and the thickness of the tube 230 material itself, calculated as the difference between the outer dimension, $T_{OD}$ and $T_{ID}$. In FIG. 5B, the outermost dimension of the tip is defined by the outer dimension, $S_{OD}$, of the speaker component. As such, the overall dimension of the tip 503 depicted in FIG. 5B is smaller than the overall dimension of the tip 203 depicted in FIG. 5A. The reduced dimensions of earbud tips enabled by the technology disclosed herein allows smaller cushions to be situated thereon, providing a more comfortable fit for user's with smaller than average ear anatomy. while retaining the speaker component in close proximity to the user's eardrum during use.

Figure 6:
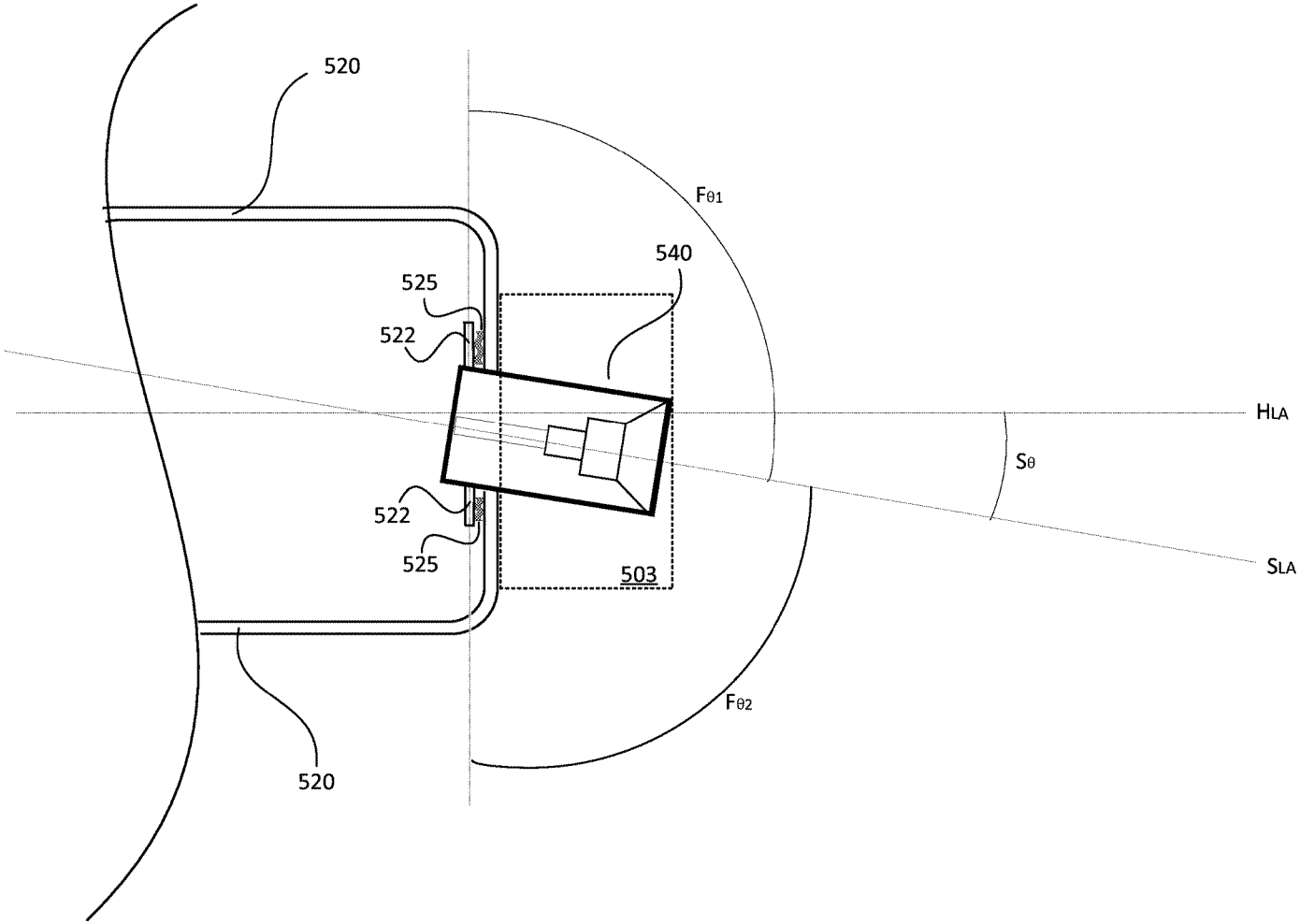
FIG. 6 is a perspective view of an earbud device in accordance with embodiments of the technology disclosed herein.

FIG. 6 illustrates a magnified cross-section side view of an optimized earbud tip in accordance with one embodiment of the technology disclosed herein. As depicted, speaker component 540 may be mechanically coupled to the housing 520 such that the longitudinal axis, $S_{LA}$, of the speaker component forms a first angle with the longitudinal axis, $H_{LA}$, of the housing. Where the flange(s) 522 depicted in FIG. 4 are shown at a substantially orthogonal angle, FIG. 6 depicts that in some embodiments flange(s) 522 may also form non-orthogonal angle(s), $F_{\theta 1}$ and $F_{\theta 2}$, with the longitudinal axis, $H_{LA}$, of the speaker component 540. Accordingly, in some embodiments a portion of one or more flange(s) 522 may form a substantially obtuse angle $F_{\theta 1}$ as measured with respect to one portion of the flange(s) 522, and a substantially acute angle $F_{\theta 2}$ as measured with respect to another flange 522 or another portion of the same flange 522. In some such embodiments the longitudinal axis, $S_{LA}$, of the speaker component 540 forms a first angle, $S_{\theta}$, with the longitudinal axis, $H_{LA}$, of the housing 520. It should be understood that the first angle, $S_{\theta}$, depicted in FIG. 6 is not restricted to angles in the plane of the cross-section. Rather, the first angle, $S_{\theta}$, between the longitudinal axis, $S_{LA}$, of the speaker component 540 and the longitudinal axis, $H_{LA}$, of the housing 520 may be any angle in the three-dimensional space. Thus, one of ordinary skill in the art will recognize that the first angle, $S_{\theta}$, may in fact be described with more particularity by defining component angles with respect to the x, y, and z axes that define the orientation of the longitudinal axis of the speaker component 540 with respect to the longitudinal axis of the housing in three dimensions. For simplicity, $S_{\theta}$ will be used to convey all such angles, and does not limit the technology disclosed herein to angles only within the two dimensional plane of the cross-section.

As described above, some embodiments include the ability to eliminate the tube portion used in current earbud models, and utilize the structure of the speaker component itself as the tip of the earbud, configuring the speaker component such that the cushion may be situated thereon. Eliminating the tube portion further reduces the diameter of the earbud tip, allowing for the design of smaller cushions to satisfy the dimensional requirements of those users with small ear canals. Nearly 10% of the population, particularly petite persons and youth, find difficulty or discomfort trying to fit the cushion and tip of current earbud models into their ear canal. Embodiments of the present disclosure enhance the comfort level and user experience of these and other users by allowing for smaller cushions to be situated on the tip of an earbud while substantially retaining the proximity of the speaker component within the user's ear canal to provide optimal sound quality.

While various embodiments of the disclosed technology have been described above, it should be understood that they have been presented by way of example only, and not of limitation. Likewise, the various diagrams may depict an example architectural or other configuration for the disclosed technology, which is done to aid in understanding the features and functionality that can be included in the disclosed technology. The disclosed technology is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the technology disclosed herein. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosed technology is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosed technology, whether or not such embodiments are described and whether or not such features are presented as being a part of a described embodiment. Thus, the breadth and scope of the technology disclosed herein should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

I claim:

1. An earbud comprising:

a housing;

a speaker component having a proximal end mechanically coupled to a distal end of the housing; and a cushion formed with an aperture fitted to an exterior portion of the speaker component;

wherein the speaker component forms a tip of the earbud, a portion of the tip extending beyond the housing in at least one direction, wherein the speaker component has a first flange at or near the proximal end of the speaker component, the first flange extending outward from the proximal end of the speaker component, wherein the first flange is mechanically coupled to the distal end of the housing such that the speaker component is secured in a fixed position relative to the housing, and wherein the first flange of the speaker component is flexibly coupled with the housing such that the speaker component can be bent at a first angle relative to the housing.

2. The earbud of claim 1, wherein the first flange is mechanically coupled to an exterior wall of the distal end of the housing with an adhesive substance.

3. The earbud of claim 1, wherein the first flange is mechanically coupled to an interior wall of the distal end of the housing with an adhesive substance, the remainder of the speaker component being disposed within and projecting through an aperture formed at the distal end of the housing.

4. The earbud of claim 1, wherein the speaker component is coupled to the housing such that a longitudinal axis of the speaker component is situated at a non-zero angle relative to a longitudinal axis of the housing.

5. The earbud of claim 1, wherein an exterior of the speaker component maintains a substantially cylindrical shape, and wherein a diameter of the speaker component does not exceed 6.1 millimeters.

6. The earbud of claim 1, wherein an exterior of the speaker component maintains a substantially cylindrical shape, and wherein a diameter of the speaker component is between 6.1 millimeters and 6.7 millimeters.

7. The earbud of claim 1, wherein the speaker component has a height dimension which does not exceed 6.1 millimeters and a width dimension which does not exceed 6.1 millimeters.

8. The earbud of claim 1, wherein the speaker component has a height dimension between 6.1 millimeters and 6.7 millimeters and a width dimension between 6.1 millimeters and 6.7 millimeters.

9. The earbud of claim 1, wherein the speaker component maintains a substantially non-cylindrical shape, and wherein a thickness of the speaker component does not exceed 6.1 millimeters.

10. The earbud of claim 1, wherein the speaker component maintains a substantially non-cylindrical shape, and wherein a thickness of the speaker component is between 6.1 millimeters and 6.7 millimeters.

11. The earbud of claim 1, wherein the cushion includes an aperture having dimensions that substantially match an outside radial profile of the speaker component.

12. The earbud of claim 1, wherein the cushion includes an aperture smaller in at least one dimension than an exterior of the speaker component when the cushion is not situated upon the speaker component, and wherein the cushion is made of a material that can flexibly adapt such that the aperture substantially matches a portion of exterior of the speaker component when the cushion is situated upon the speaker component.

13. The earbud of claim 1, wherein the first flange of the speaker component is formed from a flexible material.

14. The earbud of claim 2, wherein the adhesive substance employed to couple the first flange to the exterior housing wall is a flexible adhesive substance such that the speaker component can be bent at a first angle relative to the housing.

15. The earbud of claim 3, wherein the adhesive substance employed to couple the first flange to the interior housing wall is a flexible adhesive substance such that the speaker component can be bent at a first angle relative to the housing.

16. The earbud of claim 1, wherein a longitudinal axis of the speaker component is substantially parallel to a longitudinal axis of the housing.

17. The earbud of claim 1, wherein a portion of the speaker component is threaded at or near its proximal end, the distal end of the housing forms an aperture, and the housing wall along the boundary of the aperture is reciprocally threaded to receive the threaded portion of the speaker component.

* * * * *